United States Patent [19]

Dirksing

[11] 4,120,420

[45] Oct. 17, 1978

[54] LINED PARALLELEPIPEDAL PACKAGE FOR DISPENSING FLOWABLE MATERIALS

[75] Inventor: Robert S. Dirksing, Cincinnati, Ohio

[73] Assignee: The Procter & Gamble Company, Cincinnati, Ohio

[21] Appl. No.: 878,367

[22] Filed: Feb. 16, 1978

[51] Int. Cl.[2] ..... B65D 25/14; B65D 5/70

[52] U.S. Cl. ..... 220/416; 222/81; 222/88; 220/462; 229/17 B; 222/460

[58] Field of Search ..... 222/81, 83, 80, 86, 222/88, 83.5, 460, 541; 229/17 B; 220/462, 463, 416, 403, 404

[56] References Cited

U.S. PATENT DOCUMENTS

| | | | |
|---|---|---|---|
| 2,398,405 | 4/1946 | Brooks | 229/5.5 |
| 3,172,570 | 3/1965 | Lipschutz | 222/81 X |
| 3,254,799 | 6/1966 | Gardner et al. | 222/88 |
| 3,348,738 | 10/1967 | Hertlein | 222/88 |
| 3,433,400 | 3/1969 | Hawkins | 220/404 |
| 3,459,343 | 8/1969 | Rasmussen | 222/83.5 |
| 3,785,534 | 1/1974 | Smith | 222/460 |
| 3,902,652 | 9/1975 | Malcolm | 222/81 X |
| 3,921,892 | 11/1975 | Macie | 229/17 B |
| 3,929,260 | 12/1975 | Ernst | 222/88 |
| 4,039,118 | 8/1977 | Kawaoka | 229/17 B |
| 4,040,389 | 8/1977 | Walters | 222/81 X |

*Primary Examiner*—Davis T. Moorhead

*Attorney, Agent, or Firm*—E. Kelly Linman; John V. Gorman; Richard C. Witte

[57] ABSTRACT

A dispensing package comprising a substantially rectangular, parallelepipedal container which is suitable for stacking, a bag-type liner, and an internal funnel having its outlet end disposed adjacent a sidewall of the container so that the contents of the container can be dispensed through its side as opposed to the flap formed, multiple layered top or bottom closure is disclosed. The funnel is provided with a sufficient degree of taper that substantially all of the flowable material contained within the bag liner can gravitate from the package when the package is oriented with the funnel pointing downardly and the portions of the bag liner and the carton sidewall which span the outlet end of the funnel are breached. In a particularly preferred embodiment, the package is made suitable for dispensing particulate material disposed within the bag liner without agitation or manual manipulation of the package by providing the funnel with an angle of taper greater than the nominal angle of repose of the particulate material.

10 Claims, 13 Drawing Figures

LINED PARALLELEPIPEDAL PACKAGE FOR DISPENSING FLOWABLE MATERIALS

BACKGROUND OF THE INVENTION

1. Field of the Invention

The present invention relates generally to dispensing packages suitable for containing flowable particulate materials such as wash powders, dishwasher detergents, abrasive powders, flour, etc., or viscous slurry-like materials such as cleaning pastes, adhesives, gelatinous materials and the like. More particularly, the present invention is related to a stackable dispensing package which does not require piercing or opening of the top or bottom closures to enable dispensing of the product contained therein. Even more particularly, the present invention has relation to a stackable dispensing package, the contents of which may be discharged without agitation and without exposure of the contents to either the environment or to personnel in the area of the dispensing operation.

2. Description of the Prior Art

U.S. Pat. No. 3,433,400 issued to Hawkins on Mar. 18, 1969 discloses a transportable container having a flexible liner which can be formed into a funnel shape to dispense a particulate material through the bottom wall of the container. U.S. Pat. No. 2,398,405 issued to Brooks on Apr. 16, 1946 discloses a paperboard container having a funnel-like top portion to promote emptying of the particulate matter from the container when the carton is inverted. U.S. Pat. No. 3,902,652 issued to Malcolm on Sept. 2, 1975 discloses a rectilinear paperboard carton provided with a liquid impermeable liner, the liner being adhesively held taut beneath an area of one of the end flaps of the carton adjacent an edge thereof. The flap adjacent said area has a portion left unsecured to the liner that is removable to expose the taut liner for insertion of a pouring spout to pierce the liner. U.S. Pat. No. 3,459,343 issued to Rasmussen on Aug. 5, 1969 discloses a cartridge type package having a conical top portion which, when the cartridge is inverted, becomes a discharge funnel. U.S. Pat. No. 3,254,799 issued to Gardner et al. on June 7, 1966 and U.S. Pat. No. 3,929,260 issued to Ernst on Dec. 30, 1975 disclose dispensing packages which are adapted to cooperate with piercing means disposed in a hopper. U.S. Pat. No. 3,785,534 issued to Smith on Jan. 15, 1974 discloses a dispensing shipping container with a funnel-type pallet which container has a funnel-shaped bottom wall. Legs are disposed at each corner to support the containers so that the integrity of the bottom wall is not impaired. The legs also provide external means for enabling such containers to be stacked one on top of another.

The difficulties typically experienced with such prior art dispensing packages, however, include the necessity of breaching either multilayer top or bottom walls to initiate product dispensing, the inability to dispense the product contained within the package without external manipulation or agitation of the package, or the irregular external configuration of such packages which make handling and stacking operations difficult and inefficient from a space utilization standpoint.

OBJECTS OF THE INVENTION

Accordingly, it is an object of the present invention to provide a dispensing package comprising a substantially rectangular parallelepipedal container, a bag-type liner, and an internal funnel having its outlet end disposed adjacent a sidewall of the container so that the container can be opened and emptied through its side as opposed to having to breach a flap formed, multiple layered top or bottom closure.

It is a further object of the present invention to provide a dispensing package suitable for dispensing flowable particulate or paste-like materials without need for the operator to come in contact with the product to be dispensed.

It is yet another object of the present invention to provide a dispensing package, the contents of which can be completely emptied without need for agitation or manipulation of the package during the dispensing operation.

It is still a further object of the present invention to provide a dispensing package for flowable materials which prevents loss of any of the product being dispensed to the surrounding environment throughout the dispensing operation.

SUMMARY OF THE INVENTION

In a particularly preferred embodiment of the present invention, there is provided a dispensing package comprising a carton having a plurality of sidewalls and top and bottom closure means, a funnel, a bag-type liner having a closable top end, and a predetermined quantity of flowable product disposed within said liner, said funnel having an outlet end juxtaposed an inwardly facing surface of one of the sidewalls of said carton, said funnel having a sufficient degree of taper that substantially all of said contained product can gravitate from said dispensing package when the package is oriented with the funnel pointing downwardly and the portions of the liner and the sidewall which span the outlet end of the funnel are breached. In a preferred embodiment, the dispensing package is employed in conjunction with a flowable particulate material, and the funnel is provided with an angle of taper greater than the nominal angle of repose of the particulate material to facilitate dispensing of the product upon breach of the carton sidewall and the liner containing said particulate matter. The funnel structure may be formed in an integral fashion with the carton, or may be formed independently and subsequently inserted into the carton prior to insertion of the bag liner and the product to be dispensed. In a particularly preferred embodiment of the present invention, means are provided in the carton sidewall juxtaposed the funnel outlet to facilitate manually breaching the carton sidewall, thereby exposing the product containing bag liner.

BRIEF DESCRIPTION OF THE DRAWINGS

While the specification concludes with claims particularly pointing out and distinctly claiming the subject matter which is regarded as forming the present invention, it is believed that the invention will be better understood from the following description taken in connection with the accompanying drawings in which:

DESCRIPTION OF THE PREFERRED EMBODIMENTS

Figure 1:
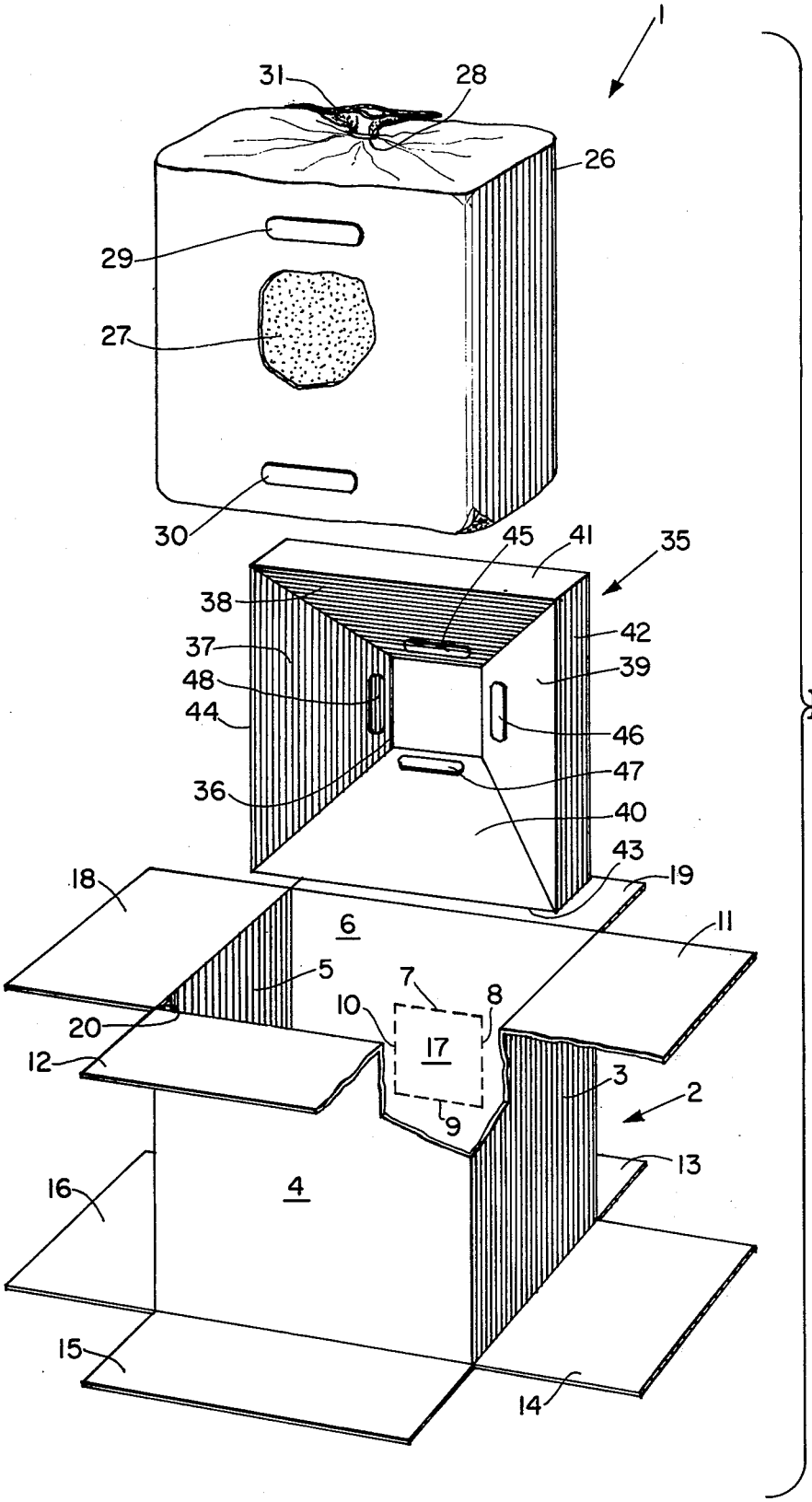
FIG. 1 is an exploded view of a preferred embodiment of a dispensing package of the present invention showing the manner in which the carton, the funnel and the product-containing bag liner are assembled.

In FIG. 1 there is illustrated an exploded view of a preferred embodiment of a dispensing package 1 of the present invention. In particular, a partially erected carton blank 2 formed from suitable material such as paperboard, corrugated board, fiberboard or any of a number of materials conventionally utilized in the cartoning art is illustrated. The particular carton material selected is not critical and will generally depend upon such factors as the overall size of the dispensing package, the density and quantity of material to be dispensed, and the handling and usage to which the dispensing package will be subjected. The partially erected carton blank 2 has a plurality of sidewalls 3, 4, 5 and 6, said side walls being secured together to form a parallelogram at one corner of the carton by means of tab 20 affixed to sidewall 4 and secured by any suitable means, such as adhesive, to sidewall 5. The partially erected carton blank 2 has a plurality of bottom closure flaps 13, 14, 15 and 16 and a plurality of top closure flaps 11, 12, 18 and 19. In the embodiment of the present invention illustrated in FIGS. 1–8, the dispensing package is cubical, and the opposing top and bottom flaps abut each other at the center of the carton when closed. The carton sidewall 6 contains a plurality of lines of weakening 7, 8, 9 and 10 which intersect one another to define a centrally located, manually removable portion 17 of the sidewall 6. The lines of weakening may take any of several well known forms including perforations, score cuts, or a combination of elements which will interact with one another to facilitate removal of the sidewall portion 17 prior to utilization of the dispensing package 1. In a particularly preferred embodiment, a fingergrip or other tear initiating device (not shown) is provided either along one or more of the lines of weakness or at the intersection of a pair of lines of weakness to facilitate manually initiating rupture of the sidewall 6 along the lines of weakness and removal of the sidewall portion 17 prior to use.

A funnel element 35 is fitted within the carton 2 such that the outlet opening 36 in the funnel is juxtaposed the removable portion 17 of the sidewall 6. In a particularly preferred embodiment of the present invention, the discharge outlet 36 in the funnel element and the removable portion 17 of the sidewall 6 are centrally located and are of substantially the same size. Removal of the sidewall portion 17 of the carton will align the window thus created in the sidewall 6 with the discharge opening 36 of the funnel 35. The funnel 35, which may be molded of any suitable material such as styrofoam, lightweight plastic, etc., or fabricated from corrugated board, fiberboard, paperboard or the like has planar tapered walls 37, 38, 39 and 40 which intersect one another along a line connecting each corner of the funnel with the corresponding corner of the centrally located discharge opening 36 in the funnel. The funnel 35 tapers from an initial height corresponding to that of the sidewalls 41, 42, 43 and 44 until it reaches at the discharge opening 36. The angle of taper $\alpha$, illustrated in FIG. 4, of the interior surfaces of the funnel 35 and the size of the discharge opening 36 in the funnel are dependent upon the flow characteristics of the particular material to be dispensed and the desired speed of dispensing, as will hereinafter be described in greater detail.

In a particularly preferred embodiment of the present invention, a small quantity of adhesive 45, 46, 47 and 48 or some other suitable securement means well known in the art is provided near the periphery of the discharge outlet 36 at the interior surface of the funnel 35 to secure the portion of the bag liner 26 adjacent the outlet in a taut manner. As will hereinafter become apparent, this facilitates rupture of the liner when the dispensing package 1 is placed in service.

Also illustrated in FIG. 1 is a bag liner 26 formed of any suitable material such as polyethylene and containing a predetermined quantity of flowable material 27 to be dispensed from the package 1. The bag liner 26 which encapsulates the free flowing material 27 prevents the escape of material from the bag until the liner is ruptured by placing the dispensing package 1 in service. The uppermost end of the liner bag is preferably secured by means of a suitable restraining device 28 such as a wire tie, a staple, a heat seal, or the like. A small amount of adhesive or other suitable securement means shown at 29 and 30 is preferably applied to the surface of the bag which is oriented opposite the funnel in the carton in order to prevent complete collapse of the bag during the dispensing operation. As will be appreciated by those skilled in the art, the bag liner 26 may be filled after insertion thereof into the carton so that it is forced to assume the shape of the carton and the funnel as the filling operation takes place, or the bag liner may be filled and sealed and thereafter inserted, with suitable manipulation, into the funnel-containing carton.

Figure 2:
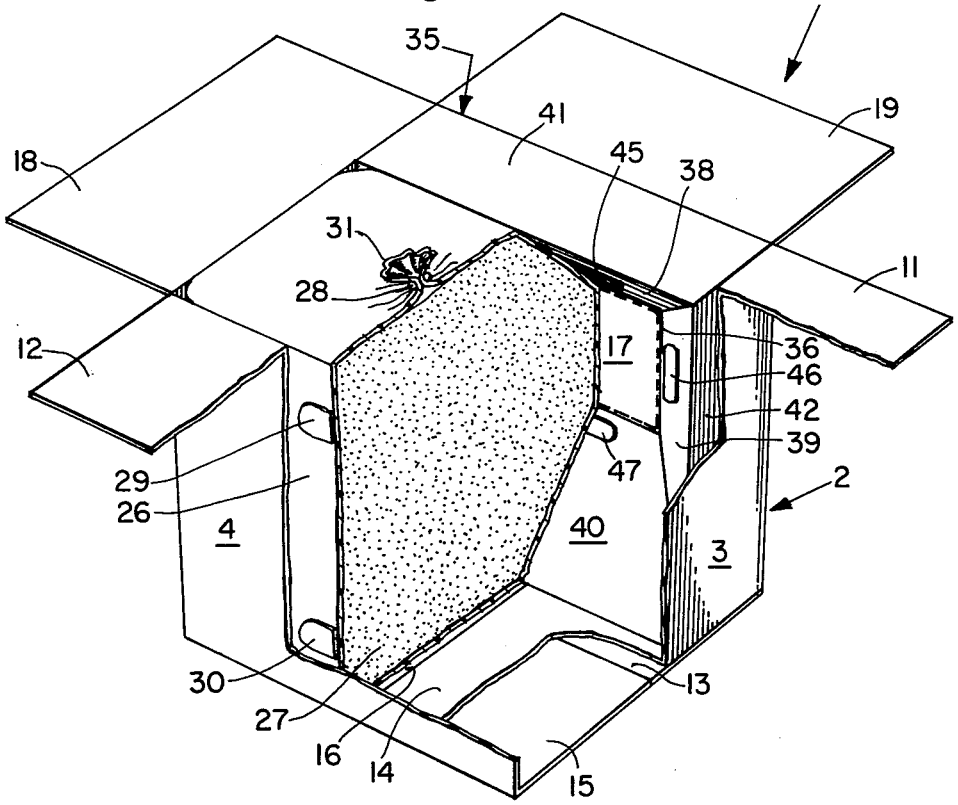
FIG. 2 is a partial cut-away perspective view of the components illustrated in FIG. 1 assembled within the confines of the carton, but prior to closing of the uppermost carton flaps.

FIG. 2 is a segmented perspective view of the carton, funnel, and bag liner illustrated in FIG. 1 in their assembled relation prior to closure of the uppermost flaps. As should be apparent from FIG. 2, the bottom flaps 13, 14, 15 and 16 of the carton are closed and secured by any means well known in the art, such as adhesive. The filled bag liner 26 containing the flowable product 27 has been caused to assume a shape substantially corresponding to the interior surfaces of the funnel 35 and the erected carton 2. The portion of the bag spanning the outlet 36 in the funnel is held taut by adhesive spots 45, 46, 47 and 48, while the portions of the bag liner oriented opposite the sidewall containing the removable portion 17 are adhesively secured to the interior surface of the sidewall 4 by means of adhesive spots 29 and 30.

Figure 3:
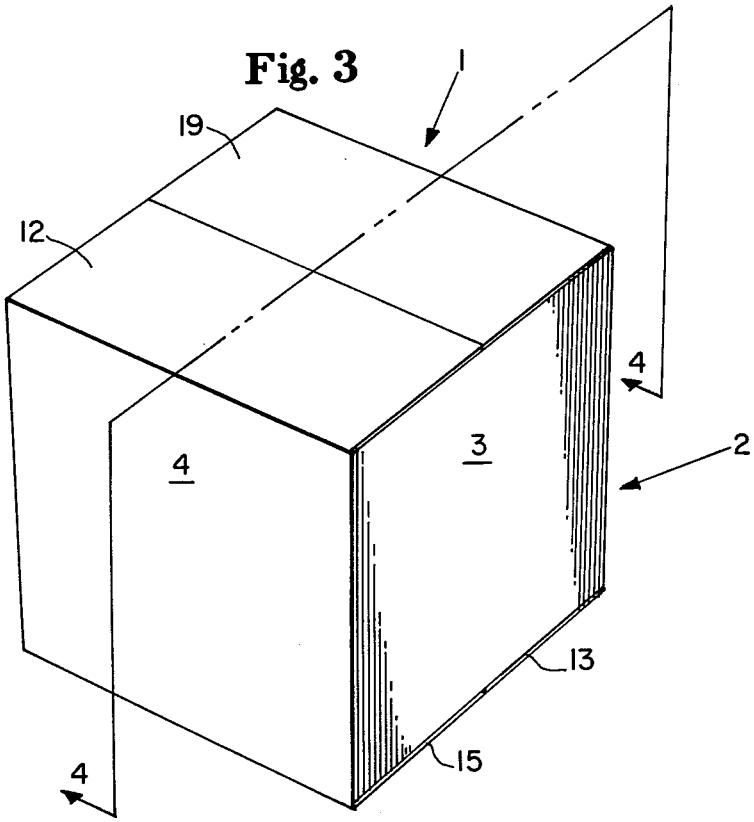
FIG. 3 is a view similar to that of FIG. 2, but showing the condition of the dispensing package after the uppermost flaps have been closed and sealed.

FIG. 3 illustrates the condition of the dispensing package illustrated in FIGS. 1 and 2 after the uppermost flaps have been closed and secured in position by means well known in the art.

Figure 4:
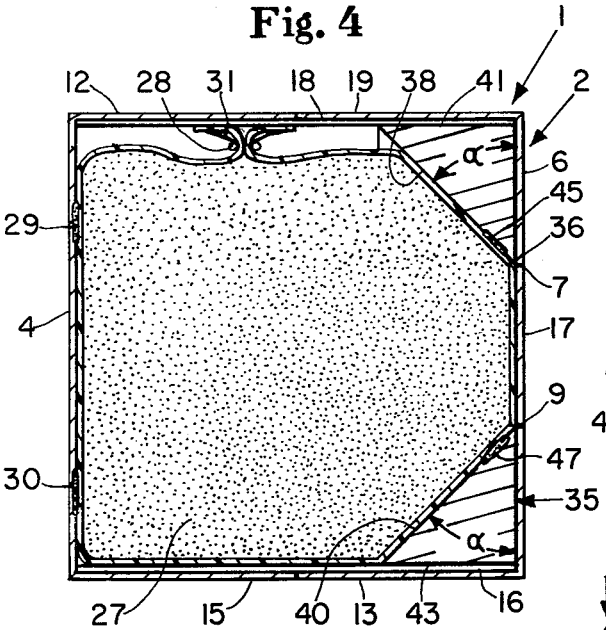
FIG. 4 is a cross-sectional view of the package illustrated in FIG. 3 taken along section line 4—4 of FIG. 3.

FIG. 4 is a cross-sectional view of the dispensing package 1 illustrated in FIG. 3 taken along section line 4—4 of FIG. 3. The angle of taper $\alpha$ formed between the interior surfaces, i.e., 37, 38, 39 and 40 of the funnel 35 and the bottom surface of the erected carton 2 is determined by the flow characteristics inherent in the product to be dispensed from the package and the rate at which dispensing is desired. It has been determined that the angle $\alpha$, in the case of a particulate material, is preferably slightly greater than the nominal angle of repose of the particulate material under the most adverse circumstance anticipated during the dispensing operation. As utilized herein, the nominal angle of repose of the particulate material shall be taken to mean the maximum angle at which the material can be inclined with respect to a horizontal plane and yet remain at rest. Since the angle of repose of most particulate materials increases somewhat with increasing moisture content, this factor must be taken into account in establishing the minimum angle of taper $\alpha$ of the funnel 35 in the event moist or humid conditions are anticipated during the dispensing operation. In most applications, the angle of taper $\alpha$ is preferably on the order of about 5° greater than the nominal angle of repose of the particulate material when dry. On the other extreme, it is preferable that the angle of taper $\alpha$ not be greatly in excess of that required to empty the contents of the dispensing package 1 without external manipulation or agitation in order to avoid unnecessary increases in packaging and handling costs due to the volume occupied by the funnel element 35, i.e., an excessively large angle of taper $\alpha$ reduces the space available within a given size package for the material to be dispensed.

As will be appreciated by those skilled in the art, a dispensing package of the present invention may also be employed to advantage in conjunction with viscous paste or slurry-like materials. In such case, the angle of taper $\alpha$ is determined primarily by the rate at which dispensing is desired, since materials of the plastic variety would, given sufficient time, ultimately be dispensed at substantially zero taper.

As will also be appreciated by those skilled in the art, the size of the removable portion 17 in the sidewall 6 and the size of the discharge opening 36 in the funnel 35 must also be taken into account in order to obtain the desired rate of dispensing.

Figure 5:
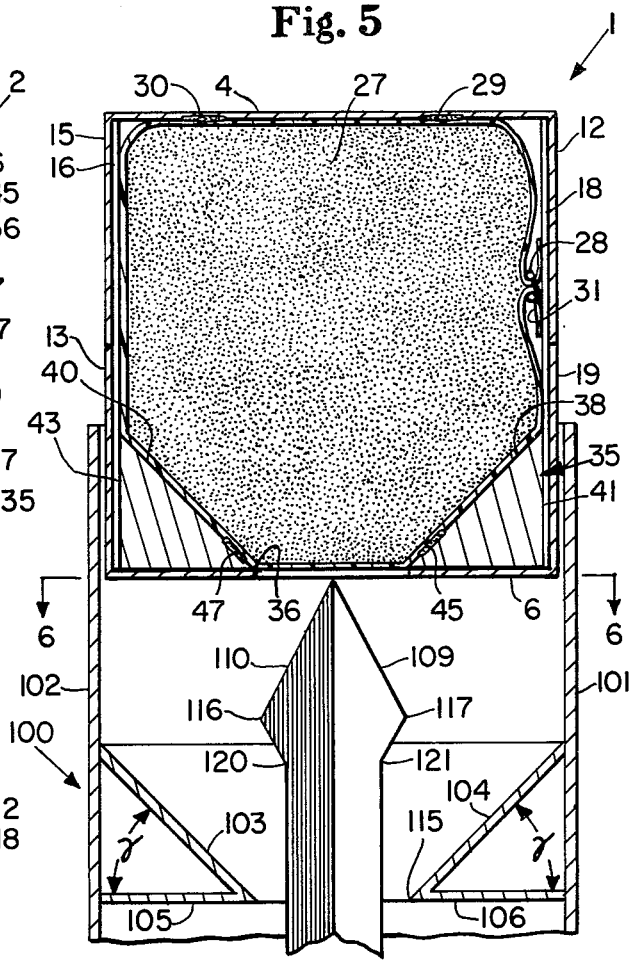
FIG. 5 is a cross-sectional view similar to that of FIG. 4, but showing a downward orientation of the funnel member prior to piercing of the bag liner by an opening device employed in a hopper suitable for use in conjunction with a dispensing package of the present invention.
Figure 6:
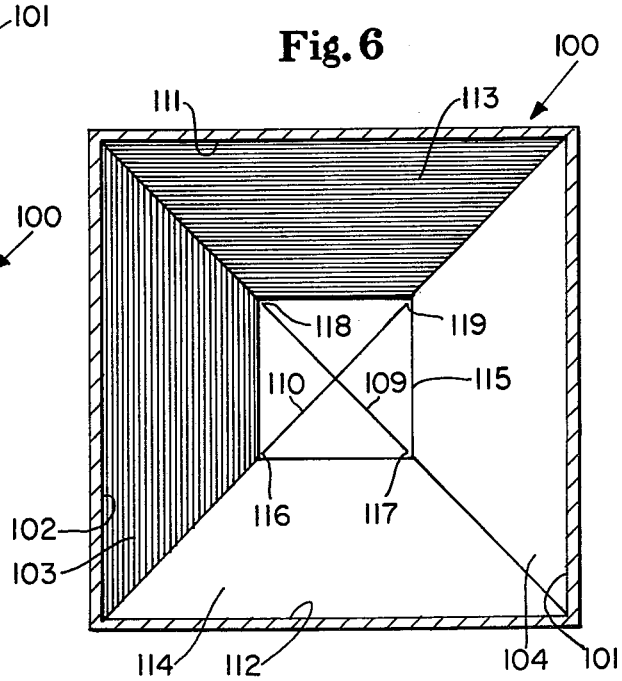
FIG. 6 is a plan view of the dispensing hopper illustrated in FIG. 5 taken along view line 6—6 of FIG. 5.

In FIG. 5, the dispensing package illustrated in FIG. 4 is about to be placed into service. The removable portion 17 in sidewall 6 of the carton 2 has been manually removed and the dispensing package 1 has been reoriented so that the discharge end of the funnel 35 contained therein is downwardly oriented. A dispensing package 1 of the present invention is preferably utilized in conjunction with a hopper 100 having interior dimensions only slightly greater than the corresponding external dimensions of the dispensing package. As is shown in FIGS. 5 and 6, the uppermost portion of the hopper 100 preferably employs substantially vertical sidewalls 101, 102, 111 and 112. Near the base of the hopper inwardly tapering sidewalls 103, 104, 113 and 114 are provided, said tapered sidewalls intersecting one another to form a discharge opening 115. In a preferred embodiment, the dimensions of the discharge opening 115 are approximately the same as those of the discharge opening 36 in the funnel 35. As is clear from FIGS. 5 and 6, a stationary piercing or rupturing tool comprised of a pair of intersecting blade segments 109 and 110 project through the discharge opening 115 of the hopper 100 in such a manner that each of the blades 109 and 110 aligns with a diagonal line connecting opposite corners of the discharge opening 36 in the funnel 35 of the dispensing package 1. The uppermost portions of the intersecting blade elements 109 and 110 form a point for rupturing the bag liner 26 when the dispensing package is inserted into the hopper. The uppermost surfaces of the intersecting blades 109 and 110 are also sufficiently sharp to cut those portions of the bag liner 26 with which they come in contact as the dispensing package 1 is lowered into the hopper 100 to the position illustrated in FIG. 7. The maximum width of the blades 109 and 110, which preferably corresponds to the diagonal measurement of the discharge opening 36 in the funnel 35, occurs at points 116 and 117, and the blades are thereafter relieved as at 120 and 121 to prevent any binding or interference between the triangular-shaped segments 61, 62, 63 and 64 of the bag liner 26 and the intersecting blades 109 and 110. As can be seen from FIG. 8, a partial view taken along view line 8—8 of FIG. 7, those portions of the bag slit by the intersecting cutting blades 109 and 110 are free to drape below the surface of the sidewall 6 in the dispensing package 1 due to the influence of the material 27 being discharged from the package. Rupturing the bag liner 26 along diagonal lines connecting the opposite corners of the discharge opening 36 in the funnel 35 provides a natural fold line along the edges of the opening formed in the carton sidewall 6 by removal of portion 17, thereby minimizing any interference of the bag with the flow of material. This aids in complete emptying of the contents 27 from the dispensing package 1 without need for agitation or manipulation thereof.

As is apparent from an inspection of FIGS. 5–8, a dispensing operation carried out with a dispensing package of the present invention may be utilized to minimize the escape of any of the material 27 contained within the bag liner 26 since the dispensing operation is not initiated until the point formed by intersecting blades 109 and 110 ruptures the liner. At this point in time, the dispensing package 1 is preferably within the confines of the hopper walls, thereby minimizing the ability of the material to enter the surrounding environment. Furthermore, when the carton sidewall 6 contacts the tapered sidewalls 103, 104, 113 and 114 of the hopper 100, the dispensing package acts as a barrier to the escape of dust due to the line of contact existing between the uppermost segments of the tapered hopper walls and the lowermost surface of the carton.

It should be noted that once the dispensing operation has been initiated in the manner described above, it will continue until the package is substantially emptied of all its contents without any agitation or manipulation of either the hopper 100 or the package 1. To avoid product back-up in the hopper during the dispensing operation it is desirable that the size of the discharge opening 115 in the discharge hopper 100 be as great or greater than the size of the funnel discharge opening 36. Furthermore, the angle of taper $\alpha$ of the tapered sidewalls of the hopper 100 is preferably as great or greater than the angle of taper $\alpha$ of the funnel 35. This ensures that the material 27 discharged from the dispensing package 1 will freely pass through the discharge opening 115 of the hopper intermediate intersecting blades 109 and 110 as rapidly as it is dispensed from the package 1.

Figure 7:
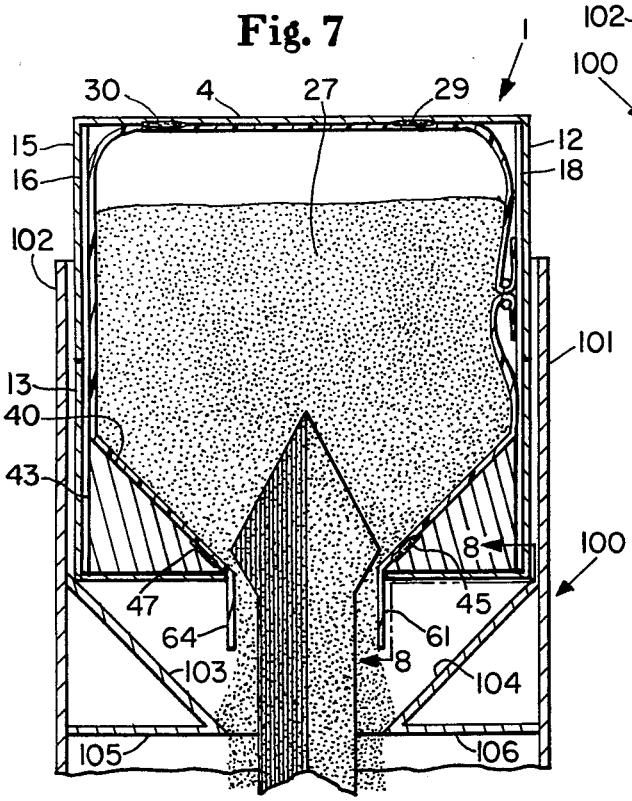
FIG. 7 is a view similar to that of FIG. 5, but illustrating the condition of the dispensing package after rupture of the bag liner by the piercing tool in the discharge hopper.

As should also be noted in FIG. 7, the purpose of adhesive portions 29 and 30 securing the portion of the bag liner 26 opposite the discharge funnel 35 to carton sidewall 4 is to prevent collapse of the emptying bag liner into the discharge opening 36 of the funnel during the dispensing operation, thereby preventing portions of the bag liner material from constricting the flow of material 27 out the discharge opening 36 in the funnel.

As will be apparent to those skilled in the art, a discharge hopper of the type generally illustrated in FIGS. 5–8 may easily be incorporated on commercial and household appliances as well as on other types of apparatus where automatic dispensing of a flowable material is desired. For example, such a hopper could be employed to dispense detergent to automatic washing machines, to dispense dishwashing detergent to automatic dishwashers, to dispense flour into food processing operations, etc.

The dispensing operation described herein is preferably carried out at atmospheric pressure. In this regard, it should be noted that the interior of the hopper 100 is preferably not subjected to vacuum during the dispensing operation in order to avoid creating undue stress on the dispensing package in the event an airtight seal should be formed between the carton sidewall 6 of the dispensing package 1 and the uppermost surfaces of the tapered hopper walls 103, 104, 113 and 114.

It will be appreciated by those skilled in the art that the size of a dispensing package of the present invention may be varied greatly. For example, dispensing packages of the present invention may be utilized to package small quantities of material suitable for use in the home by the consumer or to package large quantities of bulk materials to be transported and handled in various industrial processing operations. In either situation, the package is particularly well suited where it is desirable to minimize exposure of the contents of the package to either personnel or the environment.

Figure 9:
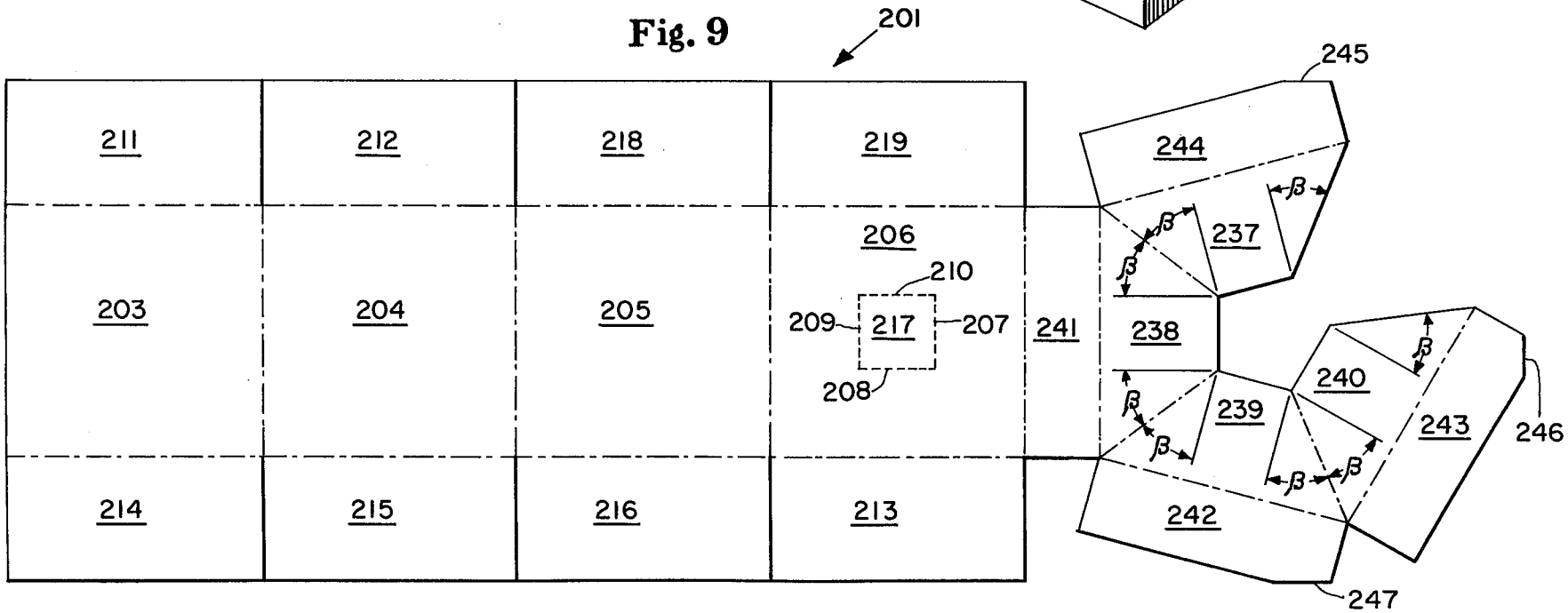
FIG. 9 is a plan view of a knocked down flat carton embodiment of the present invention wherein the funnel and carton are integrally formed from a rectangular the sidewall of the carton.

It will also be appreciated that a dispensing package of the present invention may be constructed in many different ways. For example, the funnel may be independently formed and thereafter inserted in the carton, or it may be formed in an integral fashion with the carton blank as illustrated in FIG. 9. The carton blank illustrated in FIG. 9 is shown in a knocked-down-flat configuration and is fabricated from a rectangular strip of paperboard or similar material in a manner designed to minimize material waste. In particular, the carton blank 201 is comprised of sidewalls 203, 204, 205, and 206 which are interconnected to one another along the corners of the carton, top closure flaps 211, 212, 218 and 219 joined to the uppermost edges of the aforementioned sidewalls, and bottom closure flaps 213, 214, 215 and 216 joined to the lowermost edges of the aforementioned sidewalls. Sidewall 206 contains a removable portion 217 defined by lines of weakness 207, 208, 209 and 210 which intersect one another to form a centrally located, rectangular portion 217 which is manually removable from the carton. The integral funnel portion is connected to the free edge of sidewall 206 by means of connecting tab portion 241 which determines the maximum height of the funnel to be formed. For any given set of carton dimensions and sidewall opening size 217, the length of the tapered sidewall of the funnel can be determined by the application of ordinary trigonometric principles, i.e., the angle of taper $\alpha$ of the funnel sidewall 238 in the assembled configuration is determined by taking into account the angle of repose of the material to be handled. Thus, for given dimensions of the carton sidewall 206 and given dimensions of the centrally located removable sidewall portion 217, the length of tab portion 241 required to produce the desired angle of taper $\alpha$ may readily be determined. As is apparent from FIG. 11, the length of the funnel's tapered sidewalls 237, 238, 239 and 240, as measured along the hypotenuse of the right triangle containing angle of taper $\alpha$, may also be readily determined from known trigonometric principles, given the dimensions of the centrally located removable sidewall portion 217, the overall dimensions of the carton sidewall 206 and the angle of taper $\alpha$. Once the length of the tapered sidewalls has been determined, the angle $\beta$ is determined. The angle $\beta$ and the known dimensions of the centrally located removable sidewall portion 217 may then be utilized to lay out the expanded pattern of the funnel, as illustrated in FIG. 9.

As will be appreciated by those skilled in the cartoning art, the irregular edge portions 247, 246 and 245 of tabs 242, 243 and 244, respectively, are merely the result of utilizing a rectangular strip of material to form the entire carton blank 201. In this regard, it should be noted that depending upon the overall dimensions of the carton sidewall 206, the dimensions of the centrally located removable portion 217 and the angle of taper $\alpha$ of the funnel sidewalls, the width of the funnel when laid out in knocked-down-flat condition may exceed the maximum width of material required to form the carton sidewalls and the top and bottom flaps. In such cases, it may not be feasible to completely form a carton blank of the type illustrated in FIG. 9 from a strip of material which is initially rectangular.

Figure 10:
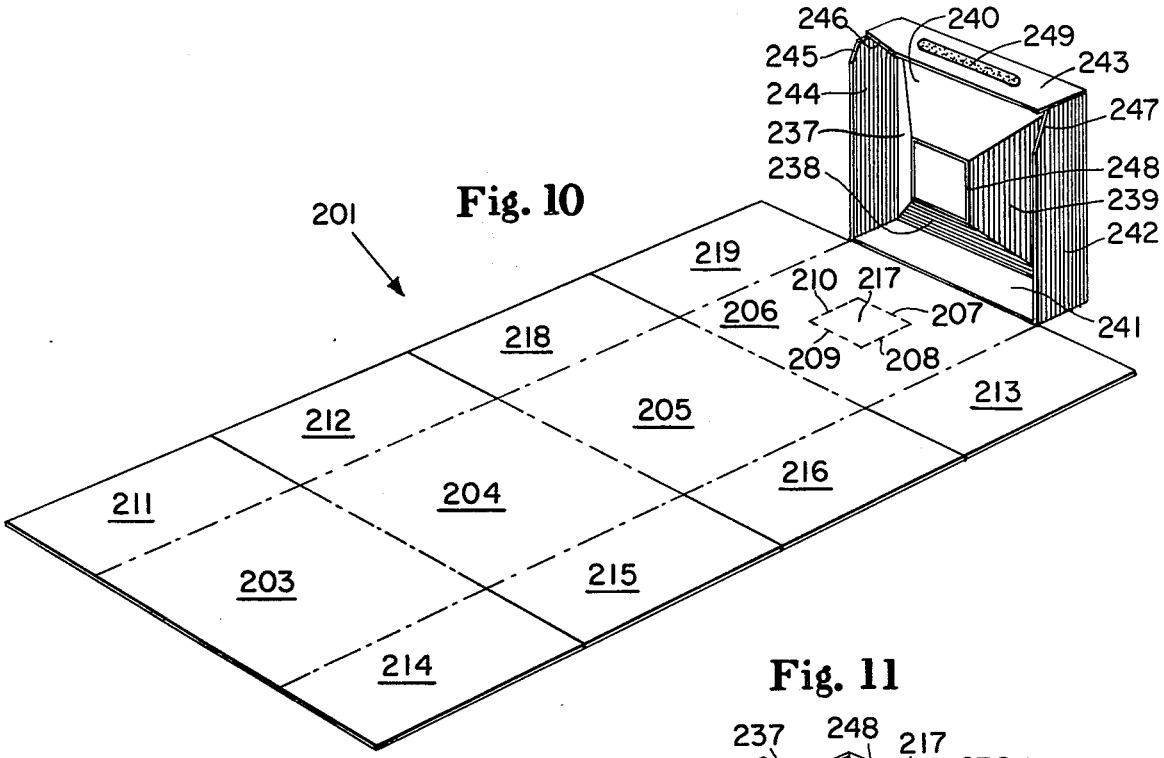

As is illustrated in FIG. 10, the tapered sidewalls 237, 238, 239 and 240 of the funnel are brought together and the tabs 241, 242, 243, and 244 are folded inwardly to provide support for the funnel. The funnel is thereafter rotated in the manner illustrated in FIG. 11 so as to align the discharge opening 248 created therein with the removable sidewall portion 217 located in the carton sidewall 206. As with the embodiment illustrated in FIG. 1, the discharge opening in the funnel 248 preferably coincides in both size and location with the removable sidewall portion 217 in the carton sidewall 206.

Figure 12:
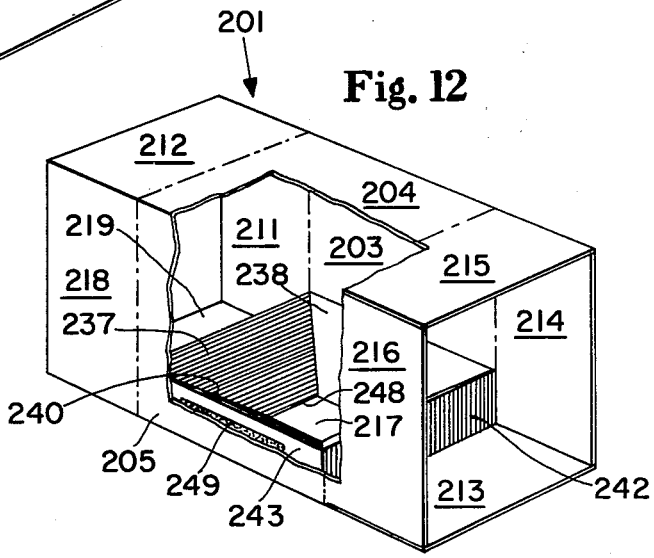
FIG. 12 is a perspective view of the carton blank illustrated in FIGS. 9–11 after the sidewalls of the carton have been secured in place, but prior to closure of the flaps of the carton and insertion of the bag liner and product.

FIG. 12 depicts the condition of the carton blank 201 when all of the sidewalls have been caused to assume their in-use orientation, thereby forming an unsealed, erected carton. The funnel formed adjacent the sidewall 206 preferably secures the carton together by means of adhesive strip 249 applied to tab 243. As will be apparent to those skilled in the art, the bottom flaps 213, 214, 215 and 216 are thereafter closed and secured together by means well known in the art, and the erected carton blank 201 containing an integral funnel is thereafter equipped with a bag liner 26 similar to that illustrated in FIG. 1. In use, the embodiment of FIG. 12 functions in all respects in a manner similar to the embodiment of FIG. 1.

Figure 13:
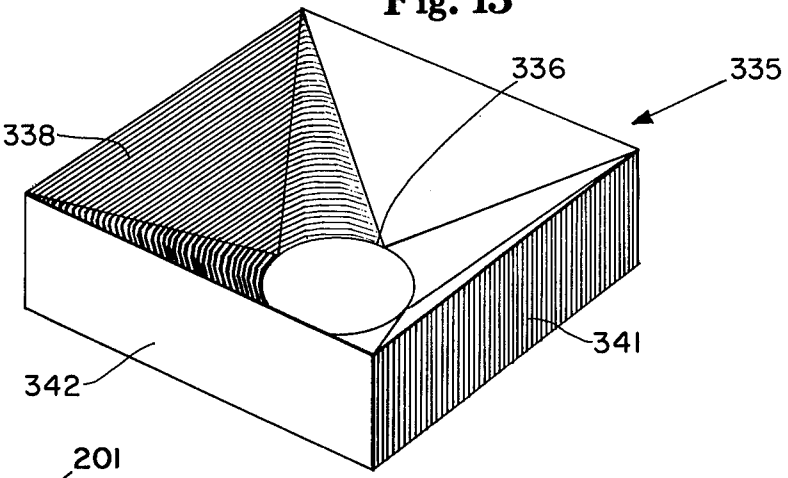
FIG. 13 is a perspective view of an alternative embodiment of a funnel member which may be inserted within a carton in the manner described herein to provide a dispensing package of the present invention.
Figure 8:
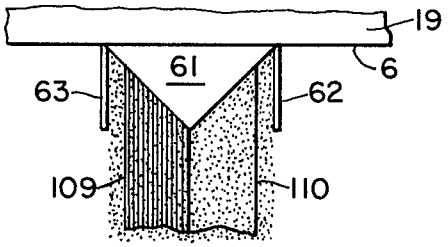
FIG. 8 is a view of the bag liner segments projecting below the lowermost surface of the dispensing package after rupture thereof, said view being taken along view line 8—8 of FIG. 7.

FIG. 13 is illustrative of yet another embodiment of a funnel member 335 which may be employed in conjunction with a dispensing package of the present invention. In particular, a dispensing funnel 335 comprised of molded plastic, styrofoam, or other suitable material is equipped with a generally conical interior surface 338 having an initial height corresponding to that of its vertical sidewalls 341, 342 and transitioning from a rectangular cross-section at the uppermost edge of its vertical sidewalls to a circular discharge outlet 336 at its base. As with the other described embodiments of the present invention, a removable portion of corresponding size and location is preferably provided in the sidewall of the carton with which the funnel member 335 is to be employed. In the event a circular discharge opening 336 is employed in the funnel 335, it is necessary only that the maximum width of the piercing tool utilized to initiate the dispensing operation not exceed the diameter of the discharge opening 336 in the funnel.

Many modifications of the invention described herein may be used, and it is not intended to hereby limit to the particular embodiments shown or described. The terms used in describing the invention are used in their descriptive sense and not as terms of limitation, it being intended that all equivalents thereof are included within the scope of the appended claims.

What is claimed is:

1. A parallelepipedal dispensing package comprising a carton having a plurality of sidewalls and top and bottom closure means, a funnel, a bag-type liner for housing a predetermined quantity of flowable material, said funnel having an outlet end juxtaposed an inwardly facing surface of one of said sidewalls, the interior surface of said funnel having a sufficient degree of taper with respect to the nominal angle of repose of said flowable material that substantially all of said flowable material can gravitate from said package when said package is oriented with said funnel pointing downwardly and when the portions of said liner and said one sidewall which span the outlet end of said funnel are breached.

2. The dispensing package of claim 1, wherein said carton is rectangular and the discharge outlet of said funnel comprises a rectangular opening having its sides oriented substantially parallel to the sidewalls of said carton.

3. The dispensing package of claim 2, wherein the interior bag liner-contacting surface of said funnel comprises four substantially planar surfaces which intersect one another to form lines interconnecting the interior corners of the dispensing package and the corresponding corners of the rectangular discharge outlet in said funnel.

4. The dispensing package of claim 3, wherein said rectangular discharge outlet in said funnel is centrally located with respect to said carton sidewall.

5. The dispensing package of claim 4, including a removable portion in the carton sidewall juxtaposed the rectangular discharge outlet in said funnel, said removable portion being defined by lines of weakness coincident with said rectangular discharge outlet in said funnel.

6. The dispensing package of claim 5 wherein said lines of weakness are comprised of perforations.

7. The dispensing package of claim 5 wherein means for manually initiating removal of said removable sidewall portion are provided along at least one of said lines of weakness.

8. The dispensing package of claim 1, wherein said carton and said funnel comprise an integral structure formed from an initially flat strip of material.

9. The dispensing package of claim 1, wherein securement means are provided intermediate the carton sidewall opposite said funnel and said bag-type liner to prevent collapse of said bag-type liner into the discharge outlet of said funnel during dispensing.

10. The dispensing package of claim 1, wherein securement means are provided intermediate said funnel and said bag-type liner about the periphery of said discharge outlet in said funnel to facilitate rupture of said bag-type liner when initiating dispensing.

* * * * *

UNITED STATES PATENT AND TRADEMARK OFFICE

CERTIFICATE OF CORRECTION

PATENT NO. : 4,120,420

DATED : October 17, 1978

INVENTOR(S) : Robert S. Dirksing

It is certified that error appears in the above-identified patent and that said Letters Patent are hereby corrected as shown below:

Column 3, lines 24-25, "the sidewall of the carton" should read --strip of material--.

Column 3, line 26, the following material should be inserted

Figure 11:
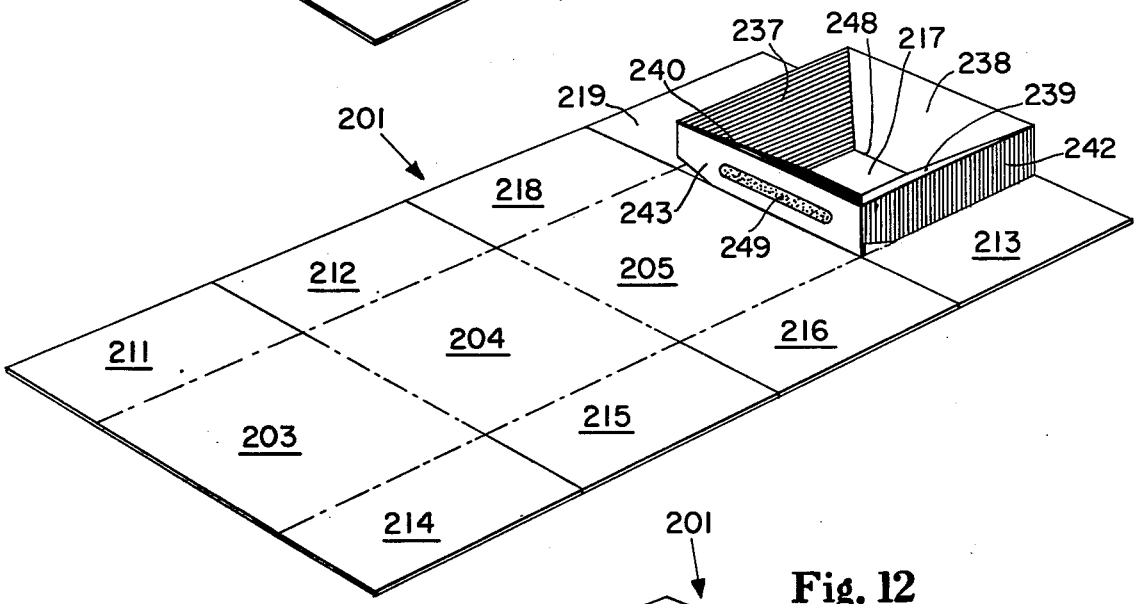

--Figure 10 is a perspective view of the blank shown in Figure 9 after the funnel portion has been erected;

Figure 11 is a perspective view of the carton blank illustrated in Figure 10 after the outlet of the funnel has been juxtaposed the lines of weakness provided in the sidewall of the carton;--.

Signed and Sealed this

*Twenty-third* Day of *January 1979*

[SEAL]

*Attest:*

RUTH C. MASON
*Attesting Officer*

DONALD W. BANNER
*Commissioner of Patents and Trademarks*